United States Patent [19]

Kahler et al.

[11] Patent Number: 4,847,626

[45] Date of Patent: Jul. 11, 1989

[54] MICROSTRIP BALUN-ANTENNA

[75] Inventors: Mark P. Kahler; Kazimierz Siwiak, both of Coral Springs, Fla.

[73] Assignee: Motorola, Inc., Schaumburg, Ill.

[21] Appl. No.: 68,510

[22] Filed: Jul. 1, 1987

[51] Int. Cl.[4] ..... H01Q 7/00; H01P 5/10

[52] U.S. Cl. ..... 343/700 MS; 343/741; 343/859

[58] Field of Search ..... 343/820–822, 343/809, 795, 859, 741, 767, 769, 700 MS, 742, 743

[56] References Cited

U.S. PATENT DOCUMENTS

| | | | |
|---|---|---|---|
| 2,187,014 | 1/1940 | Baschbeck et al. | 333/26 |
| 2,327,418 | 8/1943 | Goldmann | 343/821 X |
| 2,972,145 | 2/1961 | Watts, Jr. | 343/742 |
| 3,239,838 | 3/1966 | Kelleher | 343/789 |
| 3,571,722 | 3/1971 | Vendelin | 333/26 X |
| 3,588,905 | 6/1971 | Dunlavy, Jr. | 343/856 |
| 3,623,112 | 11/1971 | Rupp et al. | 343/727 |
| 3,678,418 | 7/1972 | Woodward | 333/26 |
| 3,845,490 | 10/1974 | Manwarren et al. | 343/821 |
| 3,947,850 | 3/1976 | Kaloi | 343/795 |
| 4,084,162 | 4/1978 | Dubost et al. | 343/700 MS |
| 4,114,163 | 9/1978 | Borowick | 343/795 X |
| 4,287,518 | 9/1981 | Ellis, Jr. | 343/700 MS |
| 4,460,877 | 7/1984 | Sterns | 333/26 |
| 4,495,505 | 1/1985 | Shields | 343/821 |
| 4,513,292 | 4/1985 | Bowman | 343/795 |
| 4,525,720 | 6/1985 | Corzine et al. | 343/895 |
| 4,623,894 | 11/1986 | Lee et al. | 343/700 MS |
| 4,737,797 | 4/1988 | Siwiak et al. | 343/821 X |

FOREIGN PATENT DOCUMENTS

| | | | |
|---|---|---|---|
| 44779 | 1/1982 | European Pat. Off. | 343/741 |
| 2621452 | 5/1976 | Fed. Rep. of Germany | 393/700 MS MS |
| 2811521 | 10/1978 | Fed. Rep. of Germany . | |
| 54-55150 | 2/1978 | Japan . | |
| 2152757 | 8/1985 | United Kingdom | 343/700 MS |

OTHER PUBLICATIONS

R. Bawer and J. W. Wolfe, "A Printed Circuit Balun for Use with Spiral Antennas" IRE Transactions on Microwave Theory and Techniques, vol. MIT-8, pp. 319–325 (May 1960).

Edward and Rees, "A Broadband Printed Dipole with Integrated Balun", Microwave Journal, pp. 339–344, May 1987.

*Primary Examiner*—Eugene R. Laroche
*Assistant Examiner*—Benny T. Lee
*Attorney, Agent, or Firm*—Mark P. Kahler; Daniel K. Nichols

[57] ABSTRACT

An balun/antenna apparatus is provided which is capable of being fabricated on a printed circuit board substrate by automated equipment. The balun-antenna includes a microstrip groundplane conductor which is split into two balanced ground arms at one end. The split groundplane conductor operates as both a balun and as a radiating conductor. A unique microstrip excitation structure is situated above the split ground elements on the opposed surface of the substrate to excite the antenna with radio frequency energy.

3 Claims, 2 Drawing Sheets

—PRIOR ART—

MICROSTRIP BALUN-ANTENNA

BACKGROUND OF THE INVENTION

This invention relates to balun transformers which are utilized for matching an unbalanced line to a balanced line. More particularly, the invention relates to a microstrip balun transformers and antennas.

In conventional radio communications applications, for example in portable and paging radio systems, antennas are used which are often fabricated by processes which are only partially automated. Unfortunately, such antennas must often still be manually adjusted or "trimmed" to the desired operating frequency. Such manual trimming and the attendant manual testing of the antenna is labor intensive and thus adds significant expense to the manufactured antenna product.

For example, prior antennas such as the half wave sleeve dipole antenna 10 of FIG. 1 are mechanically relatively complex and require manual antenna adjustment and testing to bring the antenna to the desired antenna operating frequency. The detailed structure of a typical sleeve dipole antenna is set forth below such that the complexity of manufacturing and tuning such an antenna may be fully appreciated.

In such an antenna, a wire radiator 20, which exhibits a length equivalent to approximately one-fourth wavelength in air, is fed by the inner conductor 25 of a coaxial transmission line 30. A dielectric insulator 32 separates inner conductor 25 from outer conductor 35. The outer conductor 35 of coaxial transmission line 30 is electrically coupled to feed a metallic sleeve 40 which is also approximately one quarter wavelength long in air. To improve the compactness of this antenna structure, metallic sleeve 40 is normally disposed about a portion of coaxial transmission line 30, with a uniform dielectric spacer 45 positioned to maintain the proper physical relationship between the coaxial line 30 and the metallic sleeve 40. Dielectric spacer 45 is generally cylindrical in shape and serves to establish an outer transmission line 47 wherein the outer conductor is metallic sleeve 40 an the inner conductor is the outer conductor 35 of coaxial transmission line 30. This outer transmission line is approximately one quarter of a wavelength in the dielectric material of spacer 45. A connector 55 is coupled to coaxial line 30 to facilitate connection of the antenna to radio devices.

Element 20 is typically cut during manufacture to a length which brings the resultant manufactured antenna to a frequency slightly lower than the desired operating frequency of the antenna. Additional manual frequency testing and trimming is then required to tune the antenna of FIG. 1 to the desired operating frequency. As already discussed, such additional steps are very expensive due to their manual nature. It is clear that antennas which avoid these steps are very desirable. It is also clear that antennas which are mechanically less complex are very desirable.

BRIEF SUMMARY OF THE INVENTION

One object of the present invention is to provide a balun-antenna apparatus which is capable of being manufactured by automated processes.

Another object of the present invention is to provide a balun-antenna apparatus which need not be trimmed or otherwise adjusted after manufacture to tune it to the desired operating frequency.

Another object of the invention is to provide a balun-antenna apparatus which exhibits wide bandwidth.

In one embodiment of the invention, a balun apparatus is provided which includes a substrate of dielectric material having first and second major surfaces. The apparatus includes a microstrip transmission line having a microstrip conductor situated on the first surface and a groundplane conductor situated on the second surface below the microstrip conductor. The transmission line includes input and output ends. The apparatus further includes a split loop structure having first and second conductive arms, the first and second arms having a common end coupled to the output end of the microstrip groundplane. The first and second arms exhibit a gap between the remaining ends of the arms. A microstrip excitation element is coupled to the output end of the microstrip transmission line, such element being situated on the first surface and substantially coextensive with the split loop structure therebelow.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1:
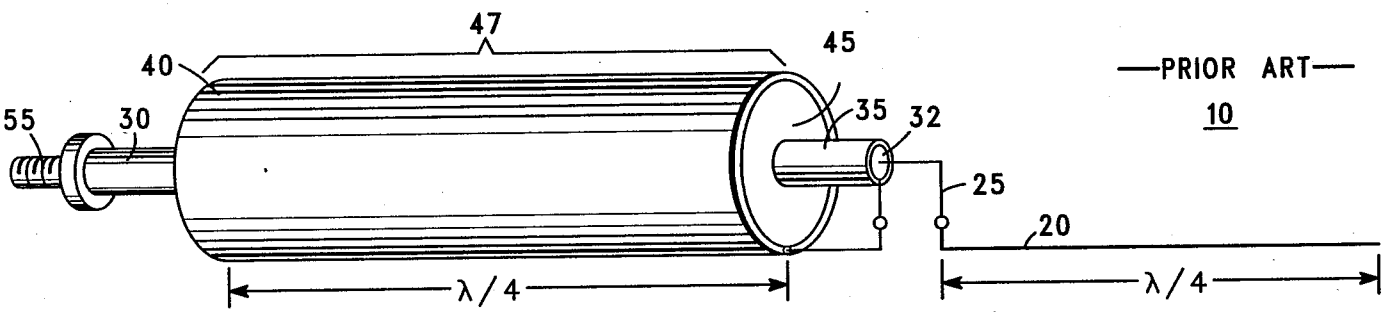
FIG. 1 is a representation of a conventional manually trimable coaxial dipole radio antenna.
Figure 2A:
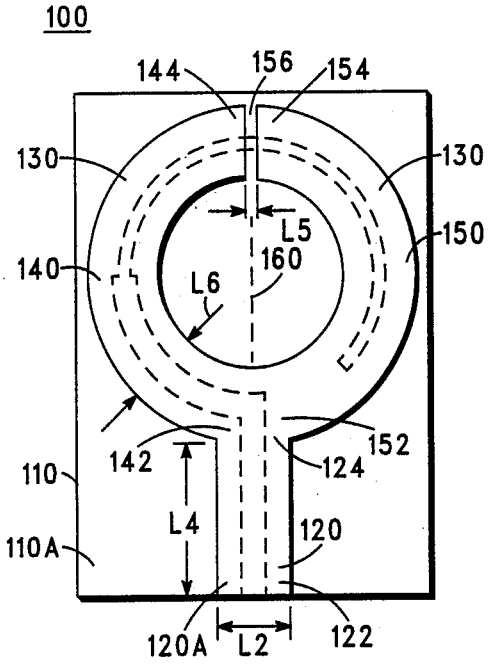
FIG. 2A is a representation of the ground side of the balun-antenna apparatus of the invention.
Figure 2B:
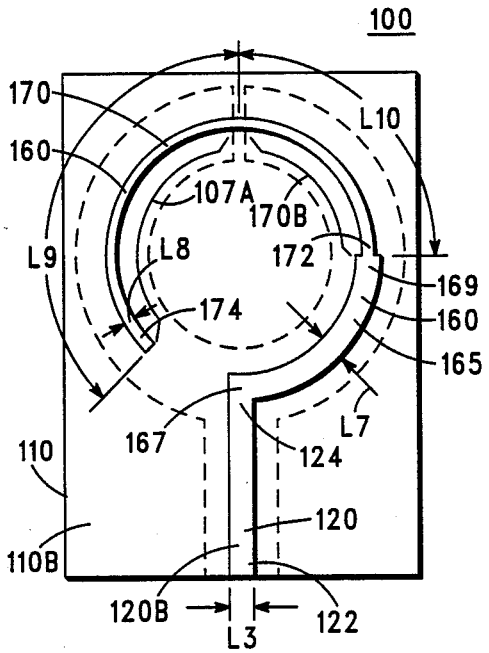
FIG. 2B is a representation of the excitation side of the balun-antenna of FIG. 2A.

One embodiment of the balun-antenna apparatus of the present invention is shown as balun-antenna 100 in FIGS. 2A and 2B. Although several dimensions are presented subsequently, in order to permit illustration of some aspects of the invention more clearly, the drawings herein are generally not drawn to scale. As illustrated in FIG. 2A, antenna 100 includes a substrate 110 of dielectric material such as glass epoxy, Teflon ®, or other electrically insulative material. In the discussion which follows, it will become clear that the invention is especially well suited to being fabricated on a double-sided printed circuit board, in which case, the insulative layer of such board is used as substrate 110. Substrate 110 includes opposed major surfaces 110A and 110B shown in FIG. 2A and FIG. 2B, respectively.

Although the particular antenna disclosed herein operates in the UHF band and exhibits a center frequency of approximately 900 MHz, those skilled in the art will appreciate that the dimensions which follow are given for purposes of example and may be scaled up or down so that the antenna will operate in other frequency ranges as well.

In this embodiment of the invention, a microstrip transmission line 120 is situated on surfaces 110A and 110B as shown in FIGS. 2A and 2B. Transmission line 120 includes a microstrip ground element 120A situated on surface 110A and a microstrip conductor 120B situated on surface 110B immediately above microstrip conductor 120A. Microstrip ground element 120A and microstrip conductor 120B are fabricated of electrically conductive material. Transmission line 120, which includes an input 122 and an output 124, is unbalanced with respect to ground.

Ground element 120A is sufficiently wide to act as a groundplane for the corresponding microstrip conductor 120B situated above ground element 120A. In general the width of ground element 120 is equal to or greater than approximately three times the width of microstrip conductor element 120B. For convenience in using antenna 100 with conventional radio receiving and transmitting equipment, the impedance of transmission line 120 is selected to be 50 ohms. Those skilled in the art will appreciate that the width of the microstrip conductor element 102B is easily modified to employ other characteristic impedances as desired.

However, in this example wherein epoxy glass with a dielectric constant of 4.8 and a thickness of 0.7 mm is used as substrate 110, microstrip ground element 120A of FIG. 2A exhibits a width L2 equal to approximately 4.3 mm. Microstrip conductor 120B of FIG. 2B exhibits a width L3 equal to approximately 1.4 mm. Returning to FIG. 2A, microstrip transmission line 120 exhibits a length L4 which is conveniently selected to be as long as the particular application dictates providing the length L4 is not so long as to cause substantial signal loss in radio frequency signals supplied to transmission line 120. With the above dimensions and substrate, the impedance of transmission line 120 is 50 ohms (unbalanced) and is constant from input 122 to output 124.

A split ground element 130 fabricated of electrically conductive material is coupled to ground element 120B at the output 124 of transmission line 120 as shown in FIG. 2A. In this embodiment, ground element 130 is a split-loop structure. For example, ground element 130 is a split circle or a split ring as shown in FIG. 2A. Those skilled in the art will appreciate that split squares, split rectangles or other split geometries may be employed to form the split loop structure of ground element 130. In the embodiment of FIG. 2A, ground element 130 includes arms 140 and 150 which each exhibit a semicircular geometry. Arm 140 includes ends 142 and 144 at each end of the semicircle which it forms. Arm 150 includes ends 152 and 154 at each end of the semicircle which it forms. Arm ends 142 and 152 are commonly coupled to transmission line output 124. A gap 156 is formed between the remaining ends 144 and 154 of arms 140 and 150 as shown in FIG. 2A. Gap 156 exhibits a width, L5, equal to approximately 1 mm. in this example. The width, L6, of ground element 130 is subject to the same criteria as the width, L2, of ground element 120.

As seen in FIG. 2B, a microstrip excitation structure 160 of electrically conductive material is coupled to microstrip conductor 120B of transmission line 120 at output 124. Microstrip excitation structure 160 is a conductive strip which generally overlies and follows along a substantial portion of the split ground arms 140 and 150 therebelow on substrate surface 110A. When radio frequency energy within the operational frequency range of antenna 100 is supplied to microstrip excitation structure 160 via transmission line 120, microstrip excitation structure 160 causes split ground arms 140 and 150 therebelow to be excited and radiate radio frequency energy.

Microstrip excitation structure 160 includes sections 165 and 170. Section 165 includes ends 167 and 169. Section 170 includes ends 172 and 174. Section 165 is coupled at end 167 to transmission line 120 at output 124 as shown in FIG. 2B and is further coupled at end 169 to end 172 of section 170 The width, L7, of section 165 is selected to be the same as the width, L3, of the microstrip conductor 120B of transmission line 120. Thus, section 165 maintains a 50 ohm impedance as it couples transmission line 120 to section 170.

At this point it is noted that in one embodiment of the antenna of the invention wherein the circumference of the loop formed by ground arms 140 and 150 is approximately one wavelength long at the selected operating frequency, the impedance of such a one wavelength loop is approximately equal to 190–j200. Section 170 includes subsections 170A and 170B each of which exhibits the same width, L8. Subsection 170A is defined as the portion of section 170 between end 174 and the center of gap 156. Subsection 170B is defined as the portion of section 170 between the center of gap 156 and end 172.

Section 170A is configured so as to resonate the reactance represented by split ground element 130. That is, the width, L8, and length, L9, of subsection 170A are selected to cause ground element 130 to resonate. For example, in this embodiment of the antenna, the length L9 and width L8 of section 170A are selected to be equal to approximately 78 mm and 0.38 mm, respectively, thus resulting in subsection 170A exhibiting an impedance of 100 ohms.

Subsection 170B is configured so as to transform the radiation resistance of ground element 130 to the impedance of section 165 and transmission line 130, namely 50 ohms in this example. For example, in this embodiment of the antenna, the length L10 and width L8 of subsection 170B are selected to be equal to approximately 46 mm and 0.38 mm, respectively. Thus, subsection 170B exhibits a 100 ohm impedance. In this manner, the approximately 200 ohm radiation resistance of split ground element 130 is transformed to a 50 ohm impedance at the point where section 165 is coupled to section 170.

Figure 3A:
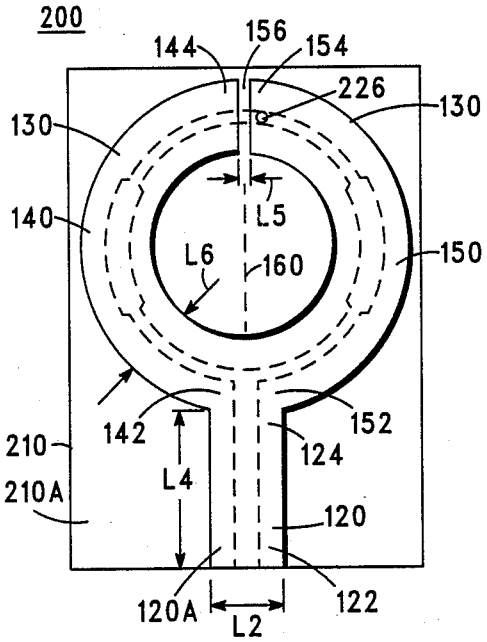
FIG. 3A is a representation of the ground side of another embodiment of the balun-antenna apparatus of the invention.
Figure 3B:
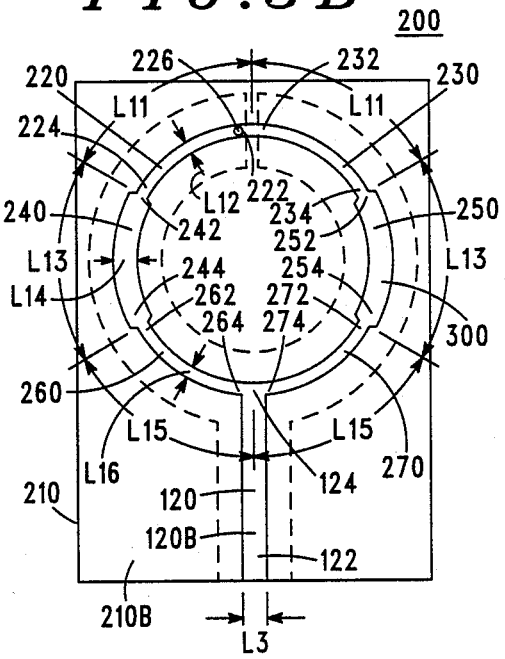
FIG. 3B is a representation of the excitation side of the balun-antenna of FIG. 3A

Another embodiment of the antenna of the invention is shown in FIGS. 3A and 3B as antenna 200. Antenna 200 is fabricated on a substrate 210 of dielectric material substantially the same as substrate 110. Substrate 210 includes opposed major surfaces 210A and 210B. The structures which are situated on substrate surface 210A are substantially the same as the structures on substrate surface 110A. That is, microstrip ground element 120A and split ground element 130 are situated on substrate surface 210A as shown in FIG. 3A. A microstrip conductor 120B is situated on surface 210B above microstrip ground element 120A in a manner similar to antenna 100 of FIG. 2A and 2B. Microstrip conductor 120B and microstrip ground element 120A together form transmission line 120 in antenna 200.

In antenna 200, the feed impedance of split ground element 130 at gap 156 is 190–j200 ohms. The split ground element 130 exhibits a circumference or perimeter of one wavelength at the 900 MHz operating frequency selected for this example of antenna 200. At 900 MHz, one wavelength in free space, $\lambda$, is equal to 333 mm. In a dielectric of 4.8 as in the present substrate 210, one wavelength in a dielectric is defined to be $\lambda$, which is 184 mm at 900 MHz.

Antenna 200 further includes microstrip conductor sections 220 and 230 which are coupled on substrate surface 210B as shown in FIG. 3B. Section 220 includes ends 222 and 224. Section 230 includes ends 232 and 234. Section ends 222 and 232 are coupled together in common and to ground element 130 via a conductive feedthrough 226 situated adjacent gap 156. Sections 220 and 230 each exhibit a length, L11, which is approximately equal to 0.2 λ′ or 36 mm in this embodiment. The width, L12, of sections 220 and 230 is selected such that the impedance of sections 220 and 230 is 100 ohms. For example, in this embodiment of antenna 200, L12 is equal to approximately 0.33 mm. The two 100 ohm lines formed by sections 220 and 230 transform the 190–j200 impedance at gap 156 to a combined impedance of approximately 6.5 ohms at section ends 224 and 234.

Antenna 200 further includes microstrip conductor sections 240 and 250 which are coupled substrate surface 210B as shown in FIG. 3B. Section 240 includes ends 242 and 244. Section 250 includes ends 252 and 254. Section ends 242 and 252 are coupled to section ends 224 and 234, respectively. Sections 240 and 250 each exhibit a length, L13, which is approximately equal to 0.25 λ′ or 0.46 mm in this embodiment. The width, L14, of sections 240 and 250 is selected such that the impedance of sections 240 and 250 is 36 ohms. For example, in this embodiment of antenna 200, L14 is equal to approximately 2.5 inches. The two parallel 36 ohm lines formed by sections 240 and 250 transform the combined 6.5 ohm impedance at section ends 224 and 234 to a combined impedance of approximately 50 ohms at section ends 244 and 254.

Antenna 200 further includes microstrip conductor sections 260 and 270 which are coupled on substrate surface 210B as shown in FIG. 3B. Section 260 includes ends 262 and 264. Section 270 includes ends 272 and 274. Section ends 262 and 272 are coupled to section ends 244 and 254, respectively. Sections 260 and 270 each exhibit a length, L15, which is sufficiently long to coupled section ends 244 and 254 to input 124 of transmission line 120 as seen in FIG. 3B. The width, L16, of sections 260 and 270 is selected such that the impedances of sections 260 and 270 are 100 ohms. For example, in this embodiment of antenna 200, L16 is equal to approximately 0.33 mm. The two 100 ohm lines formed by sections 260 and 270 couple the combined 50 ohm impedance at section ends 244 and 254 to the 50 ohm impedance which appears at output 124 of transmission line 120. The series connected microstrip conductor sections 220, 240 and 260 are connected in parallel with the series connected microstrip sections 230, 250 and 270.

Sections 220, 230, 240, 250, 260 and 270 together form an excitation element 300. When excitation element is driven with a source of radio frequency energy at approximately 900 MHz, split ground element 130 is excited and radiates that radio frequency energy. The radiating currents which are induced in split ground element 130 are orthogonal to the currents in transmission line 120. It is noted that antenna 200 is uniquely configured such that the same structure, namely split ground element 130, achieves two objectives. That is, the geometry of split ground element 130 is such that it operates as a balun which couples an essentially unbalanced transmission line 120 to a balanced radiating element, namely element 130, itself. Secondly, ground element 130 is itself the radiating structure.

Although antennas 100 and 200 have been illustrated as exhibiting a circular loop type geometry, those skilled in the antenna arts will appreciate that split ground element 130 could also be implemented as a square, rectangle or other geometrical figure which closes on itself to form a loop. It is noted that in this embodiment, split ground elements 140 and 150 are symmetrical about axis 160.

The antenna of the invention is capable of being fabricated by photolithographic masking and etching techniques with considerable cost savings over conventional antennas which are not so suited. In this case, a double sided printed circuit board is used, the board itself being employed as substrate 110. The metallization on one side of the board is employed to fabricate the conductor pattern on substrate surface 110A of FIG. 2A. The metallization on the remaining side of the printed circuit board is employed to fabricate the conductor pattern on substrate surface 110B of FIG. 2B. This fabrication can be accomplished in an automated manner. The structure conveniently requires no through the board connections. The antenna structure of FIGS. 3A and 3B conveniently requires only one direct current coupling between the excitation element 300 and ground element 130. Moreover, the resultant antennas of FIGS. 2A and 2B and FIGS. 3A and 3B require no trimming to tune such antennas to the desired operating frequency.

The foregoing describes a balun-antenna apparatus which is capable of being fabricated by automated processes and which need not be adjusted or trimmed to tune it to the desired operating frequency. The antenna exhibits a very wide bandwidth of approximately 200 MHz for the 900 MHz center frequency embodiment described above. Further, the antenna of the invention is capable of being fabricated with minimal cost.

While only certain preferred features of the invention have been shown by way of illustration, many modifications and changes will occur to those skilled in the art. It is, therefore, to be understood that the present claims are intended to cover all such modifications and changes which fall within the true spirit of the invention.

We claim:

1. A balun apparatus comprising:

a substrate of dielectric material having first and second major surfaces;

a microstrip transmission line including a microstrip conductor situated on said first surface and a groundplane conductor situated on the second surface below said microstrip conductor, said microstrip conductor and said ground plane conductor each having input and output ends;

a split loop surface having first and second conductive arms providing a geometrical shape that closes on itself, said first and second arms each having a common end respectively coupled to the output end of said microstrip groundplane, said first and second arms forming a gap between the remaining ends of said arms a microstrip excitation element coupled to the output end of said microstrip transmission line, said element including sections having differing widths and being situated on said first surface and aligned substantially coextensive with said split loop structure therebelow.

2. A balun apparatus comprising:

a substrate of dielectric material having first and second major surfaces;

a microstrip transmission line including a microstrip conductor situated on said first surface and a groundplane conductor situated on the second surface below said microstrip conductor, said microstrip conductor and said ground plane conductor each having input and output ends;

a split loop structure having first and second conductive arms providing a geometrical shape that closes on itself, said first and second arms each having a common end respectively coupled to the output end of said microstrip groundplane, said first and second arms forming a gap between the remaining ends of said arms a microstrip excitation element situated on said first surface and substantially overlaying said split loop structure, said element including sections having differing widths and extending from the output end of said microstrip transmission line above one of said arms, and across said gap, and overlaying a portion of the remaining arm.

3. A balun apparatus comprising:

a substrate of dielectric material having first and second major surfaces;

a microstrip transmission line including a microstrip conductor situated on said first surface and a groundplane conductor situated on the second surface below said microstrip conductor, said microstrip conductor and said ground plane conductor each having input and output ends;

a split loop structure having first and second conductive arms providing a geometrical shape that closes on itself, said first and second arms each having common end respectively coupled to the output end of said microstrip groundplane, said first and second arms forming a gap between the remaining ends of said arms a microstrip loop element situated on said first surface and substantially overlaying said split loop structure, said element being coupled to the output of said microstrip transmission line, said element including sections having differing widths and being coupled to one of the arms of said split loop structure at a location adjacent said gap.

* * * * *